US005628335A

United States Patent [19]

Free

[11] Patent Number: 5,628,335

[45] Date of Patent: May 13, 1997

[54] SHOCK ABSORBING CRUTCH

[76] Inventor: Michael A. Free, 105 Groveville Rd., Trenton, N.J. 08620

[21] Appl. No.: 695,132

[22] Filed: Aug. 8, 1996

[51] Int. Cl.[6] ..... A61H 3/02

[52] U.S. Cl. ..... 135/68; 135/69; 135/75

[58] Field of Search ..... 135/65, 68, 69, 135/73, 72, 74, 75, 82

[56] References Cited

U.S. PATENT DOCUMENTS

| | | | |
|---|---|---|---|
| 39,854 | 9/1863 | Wemple | 135/68 |
| D. 318,366 | 7/1991 | Goldstein et al. . | |
| D. 322,713 | 12/1991 | Daniels . | |
| 1,296,728 | 3/1919 | Yates | 135/72 |
| 2,554,653 | 5/1951 | Wisecarver | 135/68 |
| 3,016,060 | 1/1962 | Beattie, Sr. | 135/68 |
| 3,492,999 | 2/1970 | Boyd | 135/68 |
| 3,730,198 | 5/1973 | Johnston et al. | 135/73 X |
| 4,476,885 | 10/1984 | Stein . | |
| 4,625,743 | 12/1986 | Harker . | |
| 5,411,045 | 5/1995 | Davis . | |
| 5,445,175 | 8/1995 | Cho . | |

FOREIGN PATENT DOCUMENTS

| | | | |
|---|---|---|---|
| 524691 | 5/1956 | Canada . | |
| 1806713 | 4/1993 | U.S.S.R. . | |
| 190848 | 1/1923 | United Kingdom | 135/68 |
| 320562 | 10/1929 | United Kingdom . | |

*Primary Examiner*—Lanna Mai

[57] ABSTRACT

A shock absorbing crutch includes two support shafts having an upper end, a lower end, and a plurality of apertures, an arm rest including two bores positioned on the upper ends of each support rod, two screws being positioned through the bores to secure the arm rest in place, a hand grip being positioned between the support shafts and including an axial aperture extending therethrough, a bolt being positioned through the apertures in the support bars and hand grip; two stabilizing shafts each having a lower end and an upper end being positioned within the lower end of the support shaft, an extension tab being affixed to the upper end of the stabilizing shaft and positioned within an aperture of the support shaft; a shock absorber with an upper section including a spring and a lower section, the lower section being positioned within the upper section, a mounting plate coupling the shock absorber to the stabilizing shafts; and a lower shaft being positioned within the upper shaft and secured in place by the extension tab, a user positioning the hand grip and shafts at an appropriate height and securing the shafts with the extension tabs.

5 Claims, 3 Drawing Sheets

SHOCK ABSORBING CRUTCH

BACKGROUND OF THE INVENTION

1. Field of the Invention

The present invention relates to a shock absorbing crutch and more particularly pertains to comfortably and safely supporting a user while walking with a shock absorbing crutch.

2. Description of the Prior Art

The use of crutches is known in the prior art. More specifically, crutches heretofore devised and utilized for the purpose of supporting users are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,476,885 to Stein discloses an adjustable crutch.

U.S. Pat. No. 5,411,045 to Davis discloses a crutch.

U.S. Pat. No. 5,445,175 to Cho discloses a medical crutch.

U.S. Pat. No. 4,625,743 to Harker discloses a crutch.

U.S. Pat. No. Des. 318,366 to Goldstein et al. arm cushion for a crutch.

U.S. Pat. No. Des. 322,713 to Daniels discloses a crutch.

While these devices fulfill their respective, particular objective and requirements, the aforementioned patents do not describe a shock absorbing crutch for comfortably and safely supporting a user while walking.

In this respect, the shock absorbing crutch according to the present invention substantially departs from the conventional concepts and designs of the prior art, and in doing so provides an apparatus primarily developed for the purpose of comfortably and safely supporting a user while walking.

Therefore, it can be appreciated that there exists a continuing need for new and improved shock absorbing crutch which can be used for comfortably and safely supporting a user while walking. In this regard, the present invention substantially fulfills this need.

SUMMARY OF THE INVENTION

In the view of the foregoing disadvantages inherent in the known types of crutches now present in the prior art, the present invention provides an improved shock absorbing crutch. As such, the general purpose of the present invention, which will be described subsequently in greater detail, is to provide a new and improved shock absorbing crutch and method which has all the advantages of the prior art and none of the disadvantages.

To attain this, the present invention essentially comprises a new and improved shock absorbing crutch comprising, in combination: two support shafts fabricated of metal and formed in a generally cylindrical configuration, each shaft having a closed upper end, an open lower end, a hollow interior and a plurality of diametrically opposing apertures; an arm rest fabricated of elastomeric material, the arm rest having an indented upper surface and a linear lower surface, the arm rest including two small upper bores and two large lower bores, the lower bores of the arm rest being positioned on the upper ends of each support rod, two screws being positioned through the upper and lower bores to secure the arm rest in place; a hand grip fabricated of elastomeric material and including an axial aperture extending therethrough, the hand grip being positioned between the support bars, a bolt being positioned through diametrically opposing apertures in the support bars and the axial aperture of the hand grip, a nut securing the bolt in place; two upper stabilizing shafts each fabricated of metal and formed in a generally cylindrical configuration with an upper end, a closed lower end and a hollow interior, the upper end of each stabilizing shaft being positioned within the lower end of the support shaft, an extension tab being affixed to the upper end of the stabilizing shaft and positioned within an aperture of the support shaft; a shock absorber formed as hollow, generally cylindrical shaped upper and lower sections, the upper section having an open bottom, a top including a bolt and two pegs and a spring positioned within its hollow interior, the lower section having a closed top and a closed bottom including a projection bolt, the lower section being positioned within the open bottom of the upper section; a mounting plate being fabricated of metal and formed in a generally rectangular configuration, the mounting plate having a central aperture, two side bores and two mounting bolts, the mounting bolts being coupled to the lower ends of each upper stabilizing shaft, the bolt and two pegs of the shock absorber being positioned within the central aperture and side bores of the mounting plate; a lower stabilizing shaft being fabricated of metal and formed in a hollow, generally cylindrical configuration with an upper end including a screw hole and an aperture, and a lower end including an extension tab, the projection bolt of the shock absorber being coupled within the screw hole of the upper end; a safety clip formed in a generally J-shaped configuration with a straight upper end, a hooked lower end and a central screw hole, the lower end being positioned within the aperture in the lower stabilizing bar and coupled thereto, the safety clip securing the shock absorber to the lower stabilizing bar; a base shaft fabricated of metal and formed in a generally hollow, cylindrical configuration with an open top and bottom, the lower stabilizing shaft being positioned within the open top of the base shaft and secured in place by the extension tab; and a foot fabricated of elastomeric material and formed in a generally cylindrical configuration with an open top, a closed bottom and a central hole, the foot being affixed to the base shaft, in an operative orientation a user positioning the hand grip and shafts at an appropriate height and securing the shafts with the extension tabs and safety clip, a user then placing the foot of the apparatus on the ground and leaning on the arm rest to facilitate walking, the apparatus absorbing the impact which occurs with each step.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved shock absorbing crutch which has all the advantages of the prior art crutches and none of the disadvantages.

It is another object of the present invention to provide a new and improved shock absorbing crutch which may be easily and efficiently manufactured and marketed.

It is a further object of the present invention to provide a new and improved shock absorbing crutch which is of durable and reliable construction.

An even further object of the present invention is to provide a new and improved shock absorbing crutch which is susceptible of a low cost of manufacture with regard to both materials and labor, and which accordingly is then susceptible of low prices of sale to the consuming public, thereby making such a shock absorbing crutch economically available to the buying public.

Still yet another object of the present invention is to provide a new and improved shock absorbing crutch which provides in the apparatuses and methods of the prior art some of the advantages thereof, while simultaneously overcoming some of the disadvantages normally associated therewith.

Even still another object of the present invention is to provide a new and improved shock absorbing crutch for comfortably and safely supporting a user while walking.

Lastly, it is an object of the present invention to provide a new and improved shock absorbing crutch comprising combination: two support shafts having an upper end, a lower end, and a plurality of apertures, an arm rest including two bores positioned on the upper ends of each support rod, two screws being positioned through the bores to secure the arm rest in place, a hand grip being positioned between the support shafts and including an axial aperture extending therethrough, a bolt being positioned through the apertures in the support bars and the axial aperture of the hand grip, a nut securing the bolt in place; two stabilizing shafts each having a lower end and an upper end being positioned within the lower end of the support shaft, an extension tab being affixed to the upper end of the stabilizing shaft and positioned within an aperture of the support shaft; a shock absorber with an upper section including a spring and a lower section, the lower section being positioned within the upper section, a mounting plate coupling the shock absorber to the stabilizing shafts; and a lower shaft being positioned within the upper shaft and secured in place by the extension tab, in an operative orientation a user positioning the hand grip and shafts at an appropriate height and securing the shafts with the extension tabs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
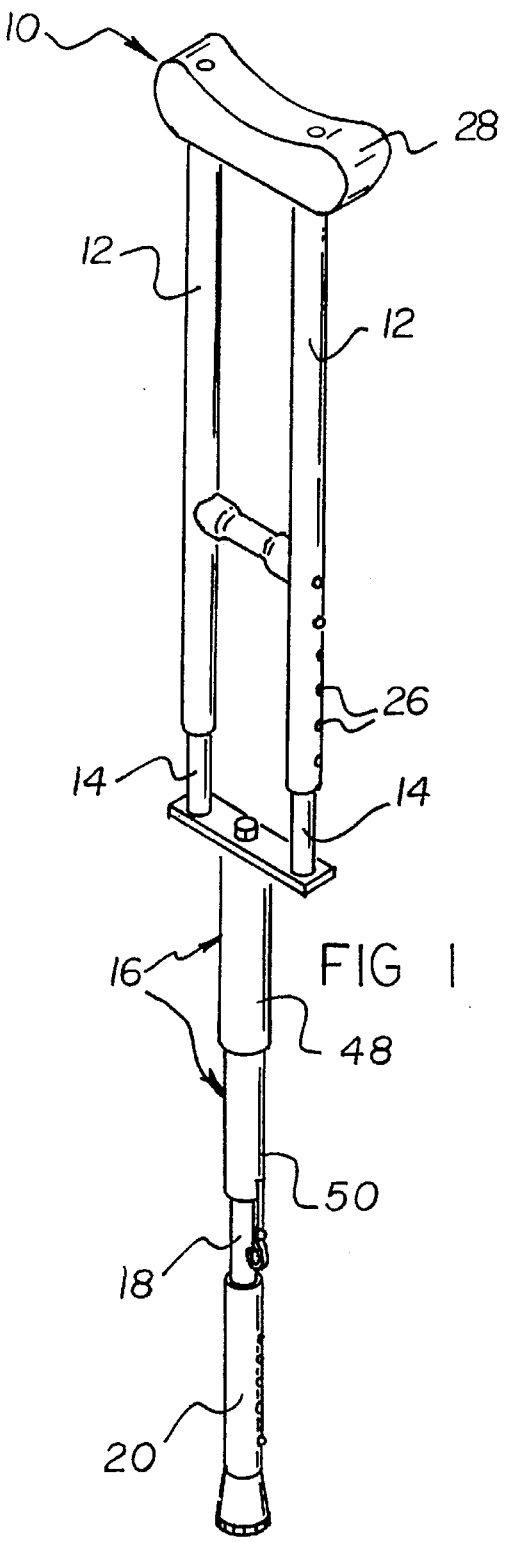
FIG. 1 is a perspective view of the preferred embodiment of the shock absorbing crutch constructed in accordance with the principles of the present invention.

With reference now to the drawings, and in particular, to FIG. 1 thereof, the preferred embodiment of the new and improved shock absorbing crutch embodying the principles and concepts of the present invention and generally designated by the reference number 10 will be described.

Specifically, it will be noted in the various Figures that the device relates to a shock absorbing crutch 10. In its broadest context, the device consists of two support shafts 12, two stabilizing shafts 14, a shock absorber 16, a lower stabilizing shaft 18, and a base shaft 20. Such components are individually configured and correlated with respect to each other so as to attain the desired objective.

The two support shafts 12 are each fabricated of metal and formed in a generally cylindrical configuration. In the preferred embodiment of the apparatus each shaft is fabricated of reinforced aluminum. Each shaft has a closed upper end 22, an open lower end 24, a hollow interior and a plurality of diametrically opposing apertures 26. The diametrically opposed apertures allow the apparatus to be used by individuals of varying heights. Note FIG. 1.

Figure 3:
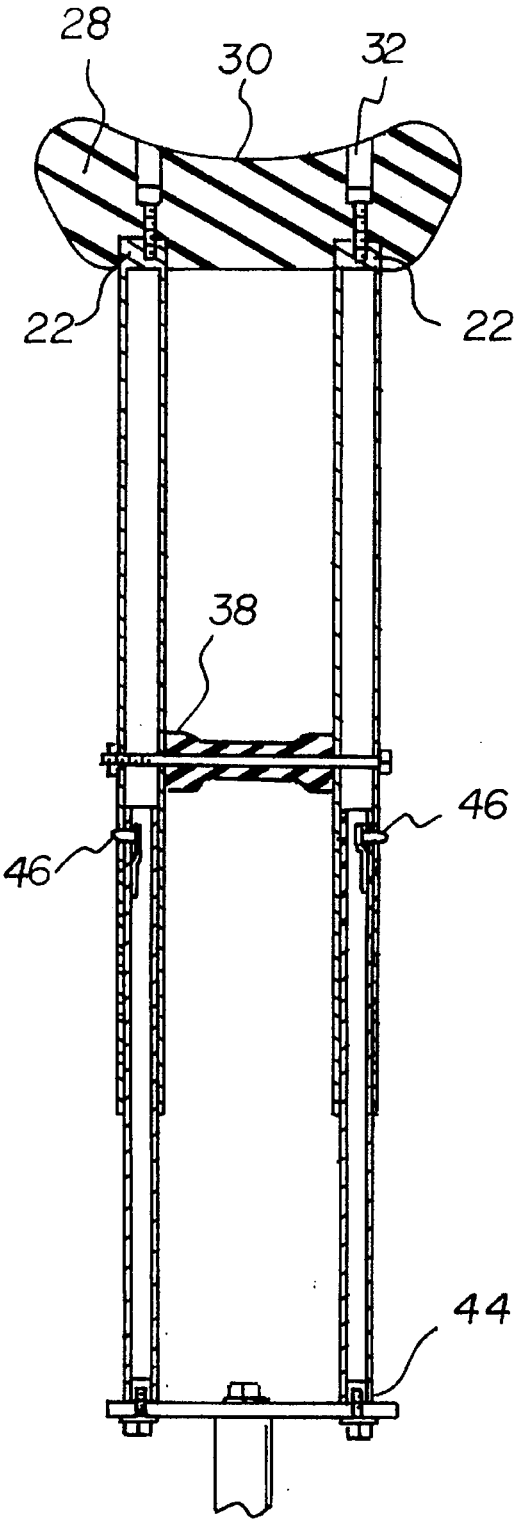
FIG. 3 is a cross sectional view of the apparatus taken along section line 3—3 of FIG. 2.

An arm rest 28 is included with the apparatus. The arm rest is fabricated of padded elastomeric material. The arm rest has an indented upper surface 30 and a linear lower surface. The arm rest includes two small upper bores 32 and two large lower bores 34. The lower bores of the arm rest are positioned on the upper ends of each support rod. Two screws 36 are positioned through the upper and lower bores to secure the arm rest in place. The heads of each screw are recessed within the bores to provide greater comfort to the user. Note FIGS. 1 and 3.

Figure 5:
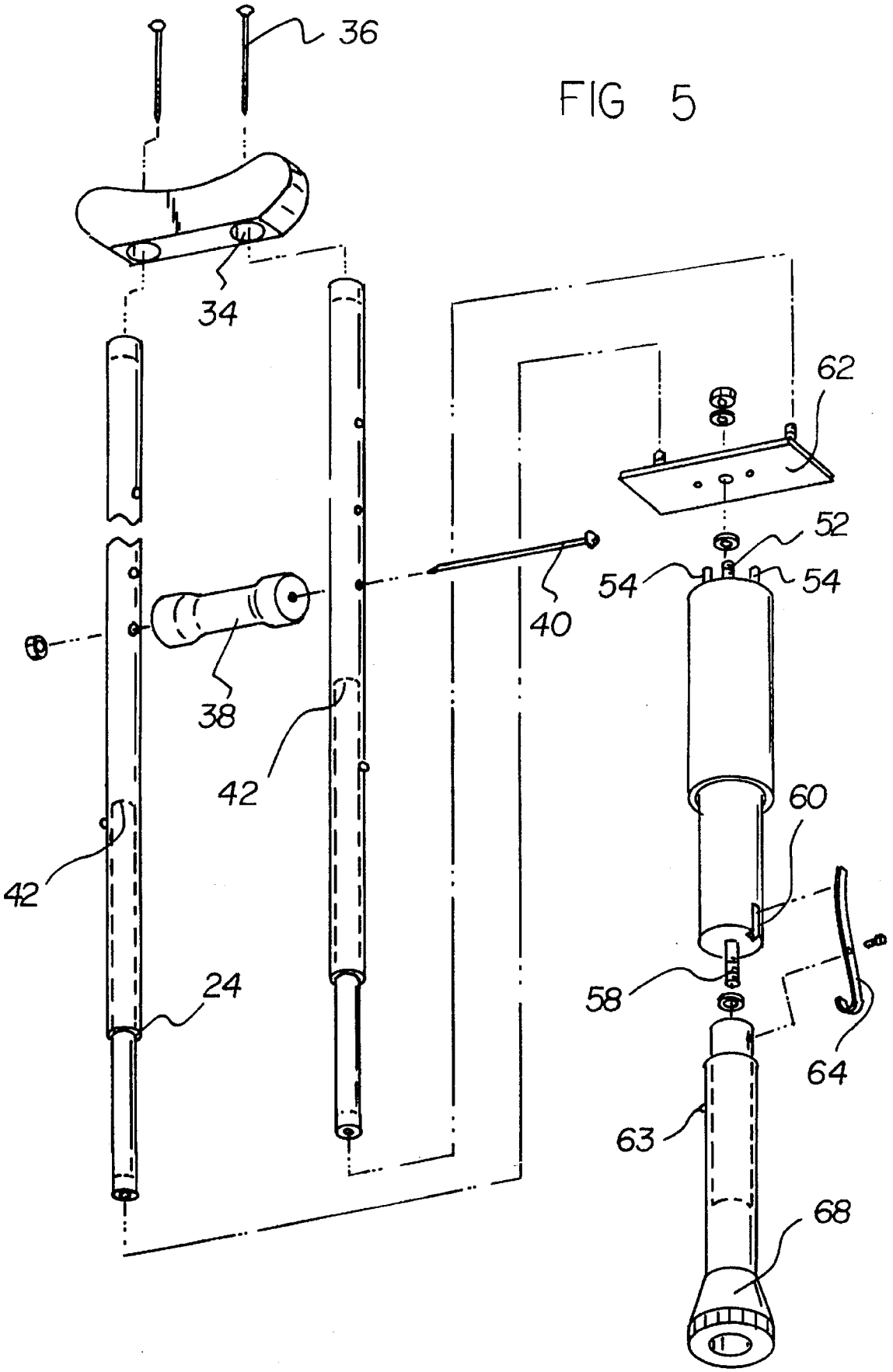
FIG. 5 is an separated view illustrating the positioning of the various components of the apparatus.

A hand grip 38 is also included with the apparatus. The hand grip is fabricated of elastomeric material and includes an axial aperture extending through it. The hand grip is cylindrical shaped and has enlargements on each end. The hand grip is positioned between the support bars. A bolt 40 is positioned through diametrically opposing apertures in the support bars and the axial aperture of the hand grip. A nut secures the bolt in place. The hand grip is movable to any of the diametrically opposed apertures in the support rod to adjust the apparatus to various heights. Note FIGS. 1 and 5.

Two upper stabilizing shafts 14 are each fabricated of metal and formed in a generally cylindrical configuration with an upper end 42, a closed lower end 44 and a hollow interior. The upper end of each stabilizing shaft is positioned within the lower end of the support shaft 24. An extension tab 46 is affixed to the upper end of the stabilizing shaft and positioned within an aperture of the support shaft. The extension tab has a linear lower section and a generally cylindrical shaped upper section. Note FIG. 3.

Figure 4:
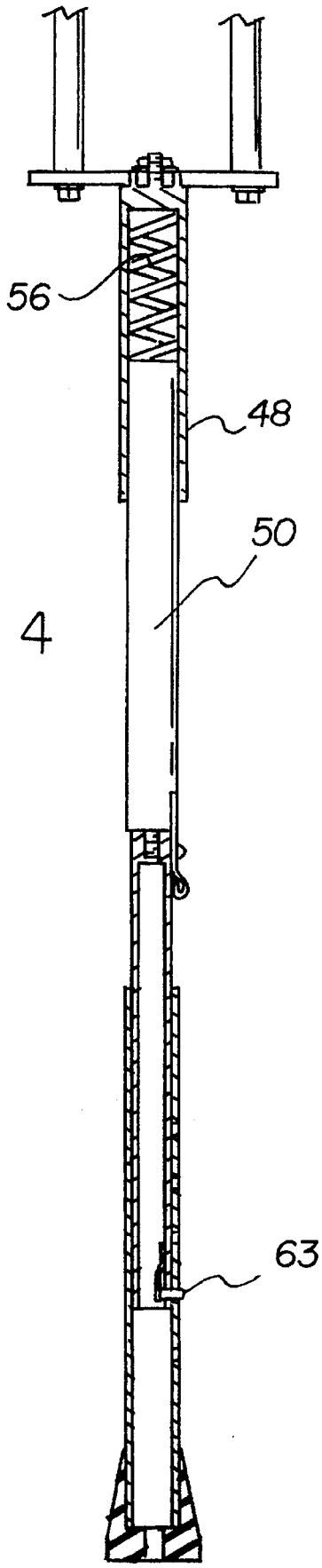
FIG. 4 is a cross sectional view of the apparatus taken along section line 4—4 of FIG. 2.

The shock absorber 16 includes hollow, generally cylindrical shaped upper 48 and lower sections 50. The upper section has an open bottom and a top. The top includes a bolt 52 and two pegs 54. A spring 56 is positioned within the hollow interior of the upper section. The lower section has a closed top and a closed bottom which includes a projection bolt 58. The lower section also includes a generally rectangular side bore 60. The lower section is positioned within the open bottom of the upper section. Note FIGS. 4 and 5.

A mounting plate 62 is fabricated of metal and formed in a generally rectangular configuration. The mounting plate has a central aperture, two side bores and two mounting bolts. The mounting bolts are coupled to the lower ends of each upper stabilizing shaft. The bolt 52 and two pegs 54 of the shock absorber are positioned within the central aperture and side bores of the mounting plate. Each bolt has an associated nut and washer to secure it in place. Note FIGS. 1 and 5.

The lower stabilizing shaft 18 is fabricated of metal and formed in a hollow, generally cylindrical configuration with an upper end including a screw hole and an aperture. The lower end of the stabilizing shaft includes an extension tab 63. The projection bolt of the shock absorber is coupled within the screw hole of the upper end. Note FIG. 5.

Figure 2:
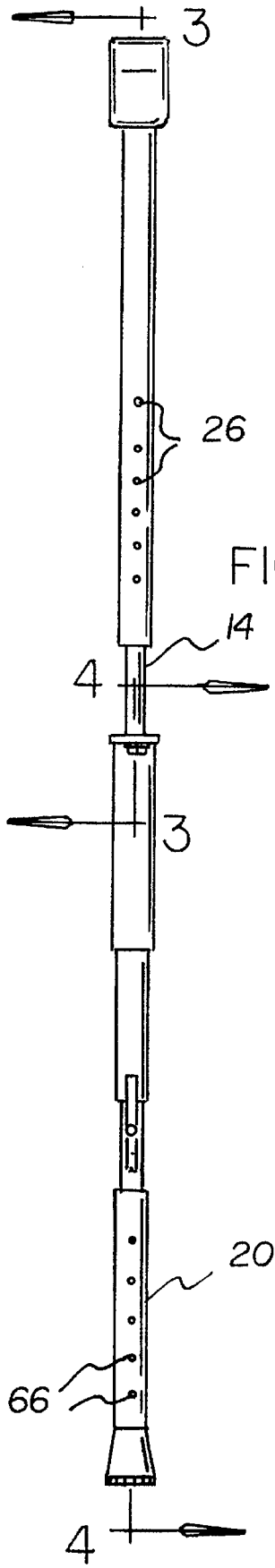
FIG. 2 is a side perspective view of the apparatus illustrating the safety lock.

A safety clip 64 is formed in a generally J-shaped configuration with a straight upper end, a hooked lower end and a central screw hole. The lower end of the safety clip is positioned within the aperture in the lower stabilizing bar and coupled to the bar. It is positioned within the rectangular side bore 60 in the shock absorber. The safety clip secures the shock absorber to the lower stabilizing bar thereby preventing uncoupling of the shock absorber from the lower stabilizing bar. Note FIGS. 2 and 4.

The base shaft 20 is fabricated of metal and formed in a generally hollow, cylindrical configuration with an open top and an open bottom. The base shaft includes a plurality of apertures 66 along its surface. The lower stabilizing shaft is positioned within the open top of the base shaft and secured in place by the extension tab 63. Note FIGS. 1 and 4.

A foot 68 is fabricated of elastomeric material and formed in a generally cylindrical configuration with a narrow open top, a wide closed bottom and a central hole. The diameter of the bottom is about two times the diameter of the top. The foot is affixed to the base shaft. In an operative orientation a user positions the hand grip and shafts at an appropriate height and secures the shafts with the extension tabs and safety clip. A user then places the foot of the apparatus on the ground and leans on the arm rest to facilitate walking. The apparatus absorbs the impact which occurs with each step. Note FIG. 1.

In the preferred embodiment the apparatus has a height of fifty five and one-half inches, a length of one inch and a width of five and one-quarter inches. The spring action of the apparatus relieves the pressure and pain under a user's arm which typically occurs when using a conventional crutch. Note FIG. 1.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved shock absorbing crutch comprising, in combination:

two support shafts fabricated of metal and formed in a generally cylindrical configuration, each shaft having a closed upper end, an open lower end, a hollow interior and a plurality of diametrically opposing apertures;

an arm rest fabricated of elastomeric material, the arm rest having an indented upper surface and a linear lower surface, the arm rest including two small upper bores and two large lower bores, the lower bores of the arm rest being positioned on the upper ends of each support rod, two screws being positioned through the upper and lower bores to secure the arm rest in place;

a hand grip fabricated of elastomeric material and including an axial aperture extending therethrough, the hand grip being positioned between the support bars, a bolt being positioned through diametrically opposing apertures in the support bars and the axial aperture of the hand grip, a nut securing the bolt in place;

two upper stabilizing shafts each fabricated of metal and formed in a generally cylindrical configuration with an upper end, a closed lower end and a hollow interior, the upper end of each stabilizing shaft being positioned within the lower end of the support shaft, an extension tab being affixed to the upper end of the stabilizing shaft and positioned within an aperture of the support shaft;

a shock absorber formed as hollow, generally cylindrical shaped upper and lower sections, the upper section having an open bottom, a top including a bolt and two pegs and a spring positioned within its hollow interior, the lower section having a closed top and a closed bottom including a projection bolt, the lower section being positioned within the open bottom of the upper section;

a mounting plate being fabricated of metal and formed in a generally rectangular configuration, the mounting plate having a central aperture, two side bores and two mounting bolts, the mounting bolts being coupled to the lower ends of each upper stabilizing shaft, the bolt and two pegs of the shock absorber being positioned within the central aperture and side bores of the mounting plate;

a lower stabilizing shaft being fabricated of metal and formed in a hollow, generally cylindrical configuration with an upper end including a screw hole and an aperture, and a lower end including an extension tab, the projection bolt of the shock absorber being coupled within the screw hole of the upper end;

a safety clip formed in a generally J-shaped configuration with a straight upper end, a hooked lower end and a central screw hole, the lower end being positioned within the aperture in the lower stabilizing shaft and coupled thereto, the safety clip securing the shock absorber to the lower stabilizing bar;

a base shaft fabricated of metal and formed in a generally hollow, cylindrical configuration with an open top and bottom, the lower stabilizing shaft being positioned within the open top of the base shaft and secured in place by the extension tab; and a foot fabricated of elastomeric material and formed in a generally cylindrical configuration with an open top, a closed bottom and a central hole, the foot being affixed to the base shaft, in an operative orientation a user positioning the hand grip and shafts at an appropriate height and securing the shafts with the extension tabs and safety clip, a user then placing the foot of the apparatus on the ground and leaning on the arm rest to facilitate walking, the apparatus absorbing the impact which occurs with each step.

2. A shock absorbing crutch comprising:

two support shafts having an upper end, a lower end, and a plurality of apertures;

an arm rest including two bores positioned on the upper ends of each support rod, two screws being positioned through said bores to secure said arm rest in place;

a hand grip being positioned between said support shafts and including an axial aperture extending therethrough, a bolt being positioned through said apertures in said support bars and the axial aperture of said hand grip, a nut securing the bolt in place;

two stabilizing shafts each having a lower end and an upper end being positioned within the lower end of the support shaft, an extension tab being affixed to the upper end of said stabilizing shaft and positioned within an aperture of the support shaft;

a shock absorber having an upper section and a lower section, said upper section includes a spring, said lower section being positioned within said lower section, a mounting plate coupling said shock absorber to said stabilizing shafts;

a foot assembly being secured to said lower section of said shock absorber, said foot assembly including an upper shaft and a lower shaft, said lower shaft being positioned within said upper shaft and secured in place by said extension tab; in an operative orientation a user positioning said hand grip and shafts at an appropriate height and securing said shafts with said extension tabs; and a safety clip securing said shock absorber to said lower shaft.

3. The shock absorbing crutch as set forth in claim 2 wherein the lower shaft is formed as a lower stabilizing shaft and a base shaft, the lower stabilizing shaft including an extension tab and being coupled to the shock absorber, the stabilizing shaft being positioned within the base shaft and secured in place by the extension tab.

4. The shock absorbing crutch as set forth in claim 1 and further including:

said safety clip formed in a generally J-shaped configuration with a straight upper end, a hooked lower end and a central screw hole; the lower end being coupled to said lower stabilizing shaft.

5. The shock absorbing crutch as set forth in claim 4 wherein each shaft is fabricated of metal and the arm rest and grip are fabricated of elastomeric materials.

* * * * *